US005372683A

United States Patent [19]

Kühn-von Burgsdorff et al.

[11] Patent Number: 5,372,683

[45] Date of Patent: Dec. 13, 1994

[54] METHOD AND APPARATUS FOR THE ELECTROLYTIC EXTRACTION OF METALS FROM A SOLUTION CONTAINING METAL IONS

[75] Inventors: Jochen-Werner Kühn-von Burgsdorff, Bruchköbel; Ulrich Ströder, Johannesberg, both of Germany

[73] Assignee: W. C. Heraeus GmbH, Hanau, Germany

[21] Appl. No.: 796,753

[22] Filed: Nov. 25, 1991

[30] Foreign Application Priority Data

Nov. 29, 1990 [DE] Germany ..... 4038065

[51] Int. Cl.[5] ..... C25C 1/00; C25C 7/00

[52] U.S. Cl. ..... 204/105 R; 204/202; 204/268; 204/269

[58] Field of Search ..... 204/202, 268, 105 R, 204/280, 203, 204, 205, 269; 205/146, 147

[56] References Cited

U.S. PATENT DOCUMENTS

| | | | |
|---|---|---|---|
| 2,344,548 | 3/1944 | Goetz | 204/203 X |
| 3,619,386 | 11/1971 | Eisner | 204/268 |
| 3,970,537 | 7/1976 | Froman et al. | 204/268 |
| 3,989,604 | 11/1976 | Austin | 204/268 |

FOREIGN PATENT DOCUMENTS

| | | |
|---|---|---|
| 0049172 | 4/1982 | European Pat. Off. . |
| 0248118 | 3/1987 | European Pat. Off. . |
| 2232903 | 3/1974 | Germany . |
| 1345411 | 9/1974 | United Kingdom . |
| 9003456 | 2/1990 | WIPO . |

*Primary Examiner*—Donald R. Valentine
*Attorney, Agent, or Firm*—Felfe & Lynch

[57] ABSTRACT

For the electrolytic extraction of metal from a solution containing metal ions and situated in a first cell, metal is cathodically deposited by means of an anode on an electrically conductive endless band immersed partially into the solution, and is redissolved anodically in the electrolyte of an adjacent second cell by partial immersion of the circulating endless band; the metal dissolved in the second cell is again deposited in high purity on a cathode.

11 Claims, 3 Drawing Sheets

METHOD AND APPARATUS FOR THE ELECTROLYTIC EXTRACTION OF METALS FROM A SOLUTION CONTAINING METAL IONS

BACKGROUND OF THE INVENTION

The invention relates to a method for the electrolytic extraction of metal from a solution containing metal ions, wherein an anode is immersed into the solution in a first cell and metal is precipitated from the solution onto an electrode. This electrode is then transferred to a second cell containing a liquid electrolyte, and the precipitated metal is released again from the electrode into the electrolyte, and reprecipitated from the electrolyte onto a counter-electrode. The electrode freed of the metal is then transferred from the second cell back into the first cell. The invention also relates to an apparatus and an electrode for the practice of the method.

In German Patent Disclosure Document 22 32 903 a method is disclosed for the electrolytic refinement of copper from salt solutions thereof contaminated with other metal ions, using titanium electrodes as the electrolyte plates. The titanium electrodes are placed as cathodes in a first solution and, after precipitation of the copper, transferred to a second bath containing pure electrolyte where 100% of the previously separated copper is released again, while the titanium electrode is connected as the anode. Titanium is used as the material of the reversible electrode, and after the anodic release of the copper the electrode can be reused immediately in the first bath without any intermediate treatment, where it is connected as the cathode; when connected anodically the titanium electrode behaves like a copper anode as long as copper adheres to the titanium anode; the passivation of the titanium, which occurs after the removal of the copper, then manifests itself in a sharp drop in current and a sharp rise in voltage. Even though good use can be made of this spontaneous current drop and voltage rise for the automatic control of the electrolysis process, the possibility of largely automatic operation is substantially limited since the shutting off of the cathodically connected titanium electrode is not so easy to control; automatic operation is problematical because special manipulating tools are necessary for the transfer of the titanium plate to the particular solution.

Another method for the electrorefinement of a metal from the group, copper, zinc, nickel, lead or manganese, using a titanium electrode as cathode, is disclosed in GB Patent 1345411. The removal of the precipitated metal from the titanium electrode is performed in this case by mechanical stripping. In one embodiment the electrical series connection of a plurality of copper refinement cells is described, with the same current flowing through all of them; at the same time different cathode current densities can be achieved depending on the size of the cathode surfaces immersed in the electrolyte.

SUMMARY OF THE INVENTION

The invention addresses itself to providing an automatically operating process for the electrolytic refinement of metals from a solution containing metal ions, wherein the transport of the electrode bearing the deposited metal to another solution is performed automatically and an adjustment can be made to optimize the process parameters. Furthermore, an apparatus and an electrode for the practice of the method are provided wherein especially an optimum utilization of energy is also achieved.

According to the method, an electrically conductive first endless band used as the electrode is circulated between the first and second cell partially immersed into the solution and the electrolyte, and in that the band is operated cathodically in the first cell and anodically in the second cell.

The apparatus has a guiding system with pulleys for guiding and driving the band, the drive pulley and several end pulleys being disposed outside of the solution and the electrolyte.

The electrode consists of a flexible, endless band whose at least outwardly facing surface is electrically conductive. At least two rolls, one driven, are disposed one over the other at a distance apart, at least one upper roll in contact with the inside surface of the endless band and one lower roll in contact with the electrically conductive surface of the band.

The endless band consists preferably of a sheet of electrically conductive material; it is also possible, however, to use an endless band in the form of a mesh or a chain. The material of the band is preferably a metal of the platinum metal group or valve metal, or a basic valve metal alloy. It is also possible to use electrically conductive plastic for the band, or a plastic containing electrically conductive filler bodies in contact with one another. The endless band thus forms a bipolar, flexible electrode. As used herein the term "endless band" means a looped sheet having no ends.

An important advantage of the invention lies in the fact that the endless band produces both the electrical connection between the individual cells and the transport of the precipitated metal to the following cell.

A very high purity is possible in the refinement process by the series operation of any desired number of similarly constructed electrolysis cells, operation of cells in cascade being possible depending on the application, with electrolyte recycling or with different electrolyte compositions in the individual cells, so that any desired precipitation morphologies can be produced. An important advantage of cascade-cell operation is the extremely low consumption of chemicals and thus also an extremely low pollution of the environment.

By connecting a number of cells in series, the metal recovery electrolysis and the refinement electrolysis can be combined in a single continuous process, so that work-intensive and energy-intensive individual steps can be avoided in the process.

DETAILED DESCRIPTION OF PREFERRED EMBODIMENTS

Figure 1:
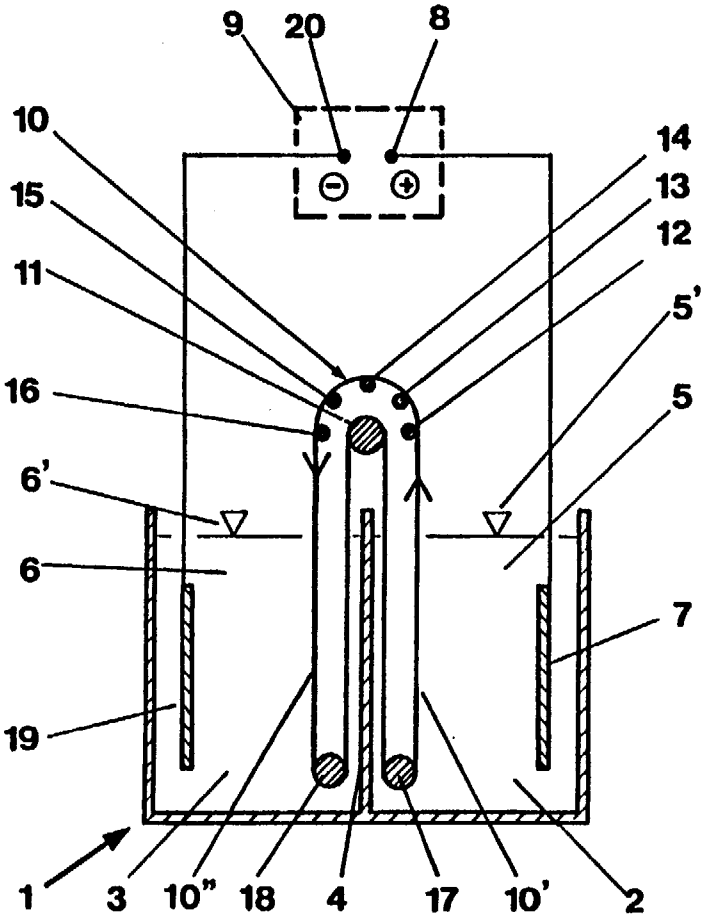
FIG. 1 is a section of an apparatus equipped with two cells for refining electrolysis.

In FIG. 1 the trough 1 consists of two trough portions or cells 2 and 3 separated by a partition 4. The solution 5 and the electrolyte 6 contained in first cell 2 and second cell 3 have respective liquid levels 5' and 6'. In solution 5 in first cell 2 is an anode 7 which is connected to the positive pole 8 of a voltage source 9. Also immersed in the solution 5 is a first section 10' of a flexible band 10 guided over the driving and guiding rolls 11, 12, 13, 14, 15, 16, 17, 18, the guiding rolls being disposed in set positions in relation to the trough. The driving and guiding roll 11 is connected with a motor (not shown) which causes the flexible band 10 to circulate on a route having a first section in said first solution and a second section in said section solution. At its second section 10'' the band 10 plunges into the electrolyte 6 of the second cell 3. The band 10 consists of a thin sheet metal with a thickness in the range from 50 to 100 μm, preferably titanium sheet metal. It is also possible, however, to use as the endless band a mesh of a platinum-group metal or a band of electrically conductive plastic or a band of electrically conductive plastic bodies linked together. In practice, the use of a mesh of platinum has proven to be especially desirable in addition to titanium sheet metal. The bottom ends of sections 10' and 10'' of the flexible band, bent in a U-shape, are carried each around end rolls 17 and 18 disposed in the bottom part of the trough sections 2 and 3; all axes of the end and guide rolls 11 to 18 are horizontal.

During operation of the system, first section 10' of the flexible band 10 operates as cathode and second section 10'' as anode; also situated in the electrolyte 6 of trough portion 3 is a cathode 19 which is connected to the negative terminal 20 of the voltage source 9.

In a practical embodiment, a contaminated copper recovery solution containing 200 g/l of sulfuric acid and 45 g/l of copper is placed in trough portion 2, the anode 7 being an insoluble electrode developing oxygen. In trough portion 3 is an aqueous sulfuric acid of 200 g/l with an electrolyte containing 45 g/l of copper. A steel plate serves as cathode 19.

During operation of the system of FIG. 1, the flexible band is circulated at a rate of about 0.2 m/min at a current density of 150 A/m$^2$ at 60° C., while copper precipitates on first section 10' of the band continuously guided through solution 5 and acting as cathode. The flexible band 10 carried over guiding rolls in the electrolyte 6 in trough portion 3 as a result of the band drive, now acts in its copper coated second section 10'' as anode, while the copper previously precipitated in solution 5 is now redissolved in trough portion 3 and second section 10'' is now operated as anode. The dissolved copper is then deposited on the cathode 19. Since the two trough portions 2 and 3 acting as electrolysis cells form a single electrolyzer with cells in series, the amount of copper deposited on the steel plate corresponds to the same amount that had previously been deposited on first section 10' of the flexible band 10 in trough portion 2. In practice, the band transport is continuous. It is also possible, however, to move the band intermittently, so that portions act step-wise as cathode and anode.

The analyses of the copper deposited on section 10' of the endless band 10 and the cathode 19 are listed in the following table:

| | Metal deposited on section 10' | Metal deposited on cathode 19 |
|---|---|---|
| Cu | 99.5% | 99.99% |
| Pb | 800 ppm | <5 ppm |
| Zn | 15 ppm | <5 ppm |
| Ni | 600 ppm | <5 ppm |
| Fe | 300 ppm | <5 ppm |
| Ag | 450 ppm | <5 ppm |

Figure 2:
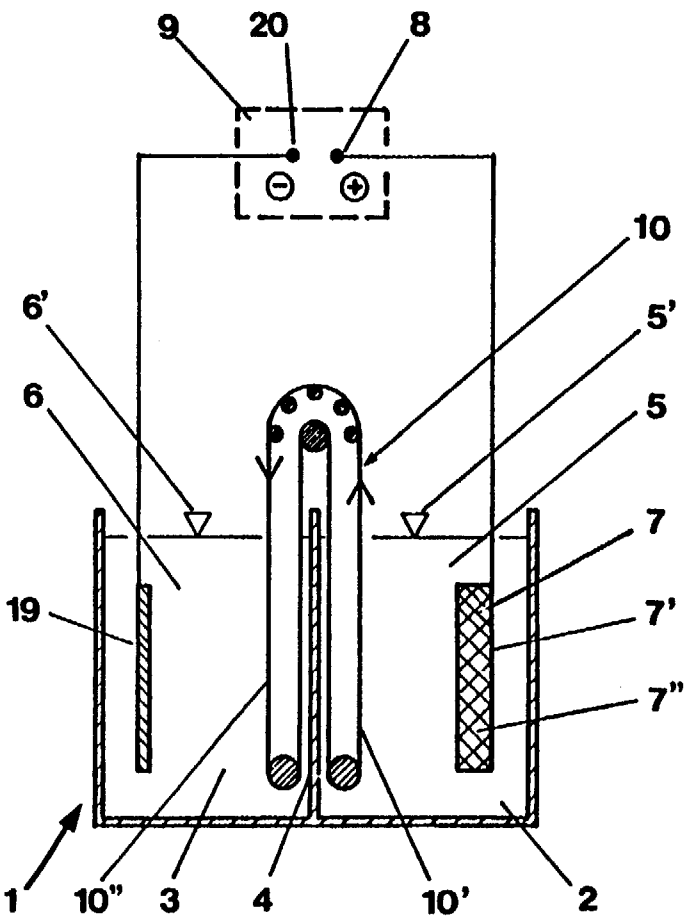
FIG. 2 is a section of a two-cell apparatus wherein the starting material is contained in granulated form in an anode basket.

FIG. 2 shows a modification of the apparatus depicted in FIG. 1, anode 7 consisting of an electrically conductive, electrolyte-resistant anode basket 7' which contains starting material 7'' in granulated form. According to FIG. 2 the starting material is deposited on section 10' of the flexible band acting as cathode, and it is carried by a transporting movement of the flexible band into the trough portion 3 where the previously deposited material is dissolved and precipitated onto cathode 19.

The following is an example of a silver refining electrolysis in an apparatus with an anode basket 7 according to FIG. 2:

The solution in the trough portions 2 and 3 consists of $HNO_3$ (nitric acid with a Ph of 3), which contains 50 g/l silver, and 5 g/l $NaNO_3$ (sodium nitrate).

Composition of the silver materials put in and recovered:

Example, Silver Refinement

| Granules in anode basket 7 | | Deposition on section 10' | Deposition on cathode 19 |
|---|---|---|---|
| Ag | 88% | 98% | 99.9% |
| Cu | 9% | 1% | <50 ppm |
| Pb | 1.5% | 0.2% | <10 ppm |
| Au | 0.5% | | |
| Balance | Pd, Sn, Ni, Zn | Au, Pd, Ni, Zn | |

Figure 3:
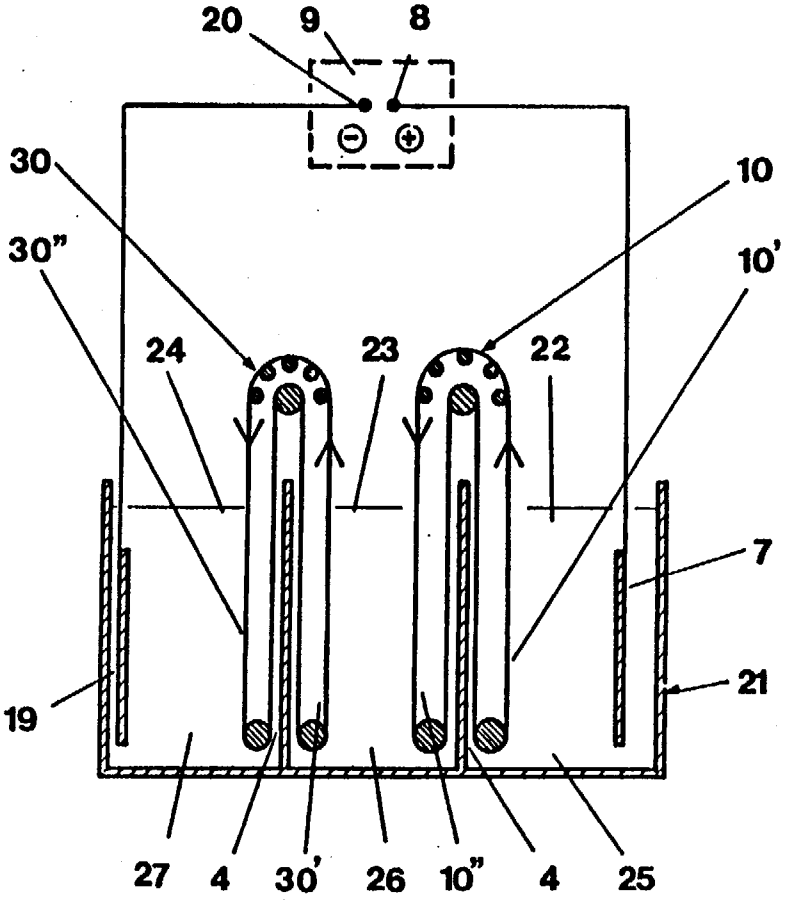
FIG. 3 is a section of an apparatus equipped with three cells, wherein the counter-electrode of the second cell is in the form of a circulating endless band.

Another embodiment is shown in FIG. 3, wherein the trough 21 is divided into three portions or cells 22, 23 and 24. Between the trough portions are partition walls 4. The basic manner of operation of the first cell 22 formed in trough 21 and containing solution 25 is the same as explained in connection with FIGS. 1 and 2. In second cell 23, however, section 10'' serves as anode in the electrolyte 26 present therein, in which the previously deposited metal content is dissolved in electrolyte 26 and is deposited on first section 30', acting as cathode, of a second electrically conductive endless band 30. The flexible band 30 is of the same construction and operation as first band 10 described in connection with FIGS. 1 and 2, and the driving and guiding rolls also are the same as in the known embodiment. The second band 30 circulates on a route having a first section in said second solution and a second section in said third solution. The flexible band 30 thus acts in second cell 23 with its first section 30' as cathode, while in the adjacent third cell 24 it acts as anode with its second section 30'', and the previously deposited metal is redissolved and deposited onto the cathode 19.

In the operation of the embodiment depicted in FIG. 3, the solution 25 and the electrolytes 26 and 27 also contain an electrolyte of sulfuric acid and copper dissolved therein, as described in connection with FIG. 1; a copper plate again serves as anode 7, or an anode basket for rough granules as in FIG. 2. For the precipitation a cathode 19 of steel is also provided, as described in connection with FIGS. 1 and 2. The transport of the first and second flexible bands 10 and 30 can be continuous or intermittent; at the same time it is possible to provide for a coupling between the drives of the transport means for the flexible bands 10 and 30. This kind of arrangement is suitable especially for the combination of a recovery electrolysis in trough portion 22 and a refining electrolysis in trough portions 23 and 24.

It is possible, of course, in order to improve the fineness (deposition of 99.999% Cu starting with a material of the purity stated in the above table) of the refining electrolysis to provide additional trough portions which are connected together like portions 23 and 24.

Figure 4:
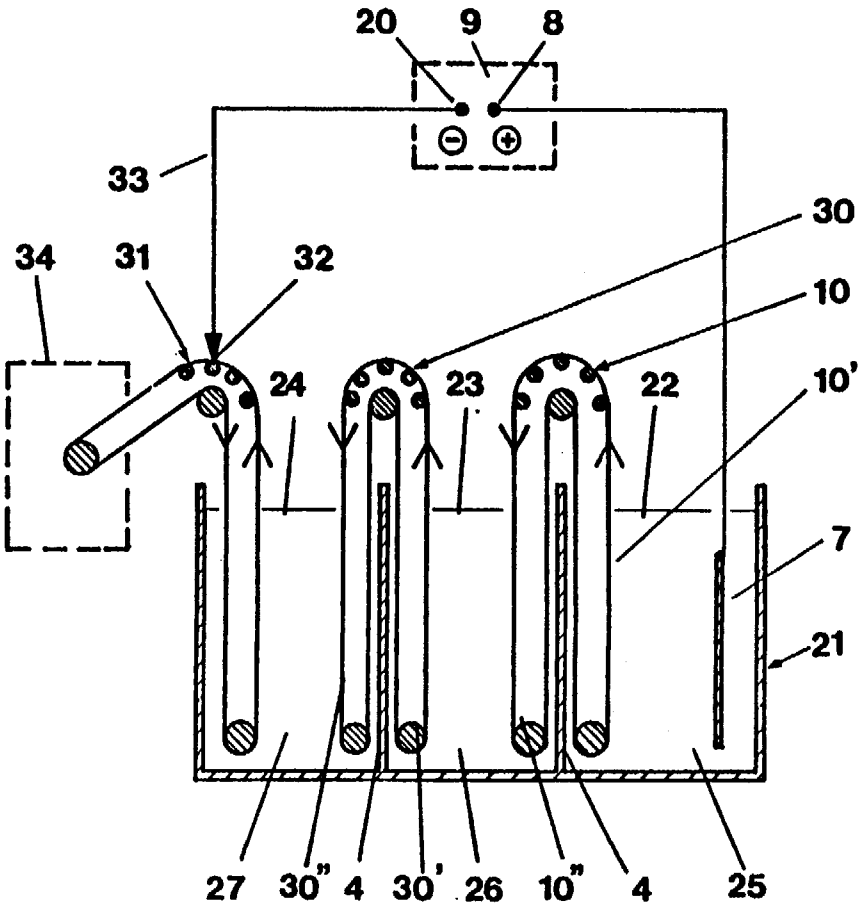
FIG. 4 is a section of a three-cell apparatus wherein the counter-electrode of the third cell is also in the form of an endless band, the precipitated metal being removed mechanically outside of the electrolyte.

In FIG. 4, the apparatus shown in FIG. 3 is provided, instead of a flat plate counter-electrode, with a circulating, electrically conductive endless band 31 as cathode; the endless band 31 is connected by a sliding contact 32 and line 33 to the negative pole 20 of the direct-current source 9; the section 30" plunging into trough portion 24 acts, as already explained in connection with FIG. 3, as an anode, and the metal previously precipitated on section 30' in trough portion 23 is now dissolved in electrolyte 27; after depositing the metal on the cathodically connected endless band 31, the band runs through a mechanical separating device 34 to remove the deposited metal from the band. In the separating device 34 the endless band 31 passes through a drying apparatus in which the deposited metal is dried, and a stripping apparatus in which the dried metal is removed from the band by revolving brushes and scrapers.

Figure 6:
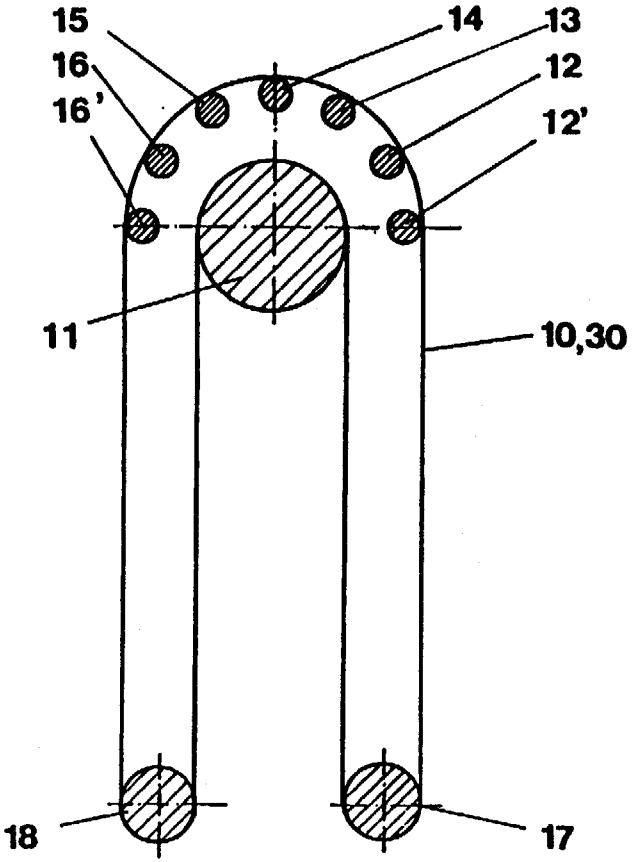
Figure 5:
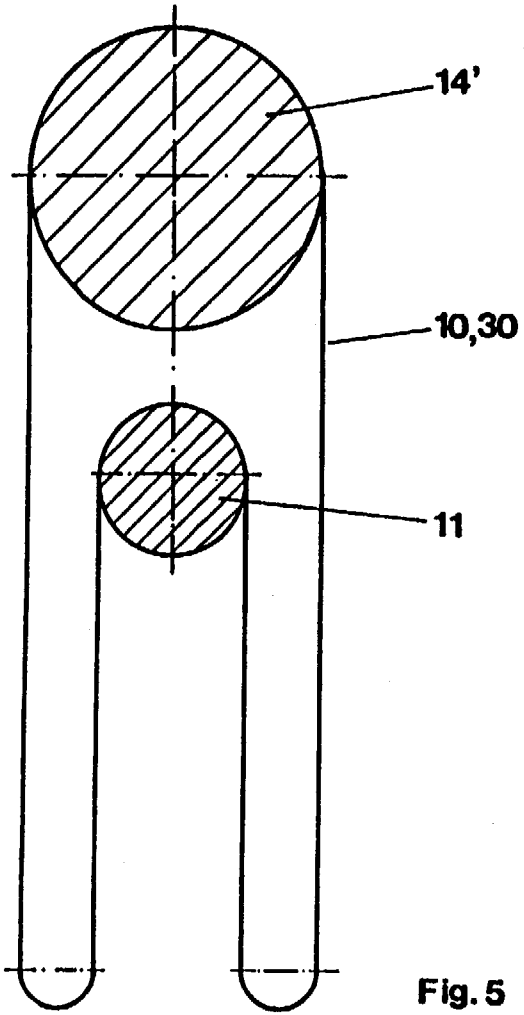
FIG. 5 shows an alternative embodiment for the guidance of the endless band, FIG. 6 details the principal embodiment for the guidance of the endless band.

Additional possibilities for the guidance of the endless band 10, 30, are further explained with the aid of FIGS. 5 and 6.

FIG. 5 represents a guidance of the endless band 10, 30, in the simplest possible form.

According to this figure the endless band is guided by two rolls of different diameter, 14' and 11, which are disposed one over the other and at a distance from one another; the upper roll is a driving and end roll 14' and is in contact with the inside surface of the endless band. It has a greater diameter than the lower end roll 11 which is in contact with the other surface of the endless band 10, 30.

The endless band forms on both sides of the rolls 14' and 11 flanking, dependent loops which are designed to plunge into the solution or electrolytes.

According to FIG. 6, it is also possible, in a manner similar to FIG. 1, to provide a plurality of small rolls instead of a single large upper roll, two additional rolls 12' and 16' being disposed according to FIG. 6, which are in contact with the inside surface of the endless band like the other rolls 12, 13, 14, 15, 16; roll 14 is provided as an end roll and driving roll; at a distance below this roll the bottom end roll 11 is disposed which is in contact with the outside face of the endless band 10, 30. The flanking loops of the endless band 10, 30, designed to plunge into the solution or the electrolyte, are provided on both sides of roll 11, the two bottom loop ends having each an additional end roll 17, 18, for stabilization of the band movement. Such an embodiment is suitable especially in the case of a cogged transfer of the drive force from the drive roll to the endless band.

It is also possible, however, to provide the lower end roll 11 as the drive roll instead of roll 14; such an embodiment permits a better transfer of force between the drive roll and the endless band.

What is claimed is:

1. Method for electrolytic recovery of metal from a first solution containing ions of said metal, comprising providing a first cell containing a first solution containing electrolyte and ions of metal to be recovered and an anode, providing a second cell containing a second solution containing an electrolyte and a cathode having a negative voltage with respect to said anode in said first cell, providing a first electrically conductive endless band on a route having a first section in said first solution, and a second section in said second solution, circulating said first band on said route from said first solution to said second solution, whereby said first band acts as a cathode in said first cell and as an anode in said second cell, and maintaining a current density which is sufficient to cause said metal to be deposited on said first band in said first cell, released from said first band into said second solution, and deposited on said cathode in said second cell.

2. Method as in claim 1 further comprising providing a third cell containing a third solution containing an electrolyte and a cathode having a negative voltage with respect to said anode in said first cell, providing a second electrically conductive endless band on a route having a first section in said second solution, where said second band acts as said cathode in said second cell, and having a second section in said third solution, where said second band acts as an anode, circulating said second band on said route from said second solution to said third solution, and maintaining a current density which is sufficient to cause metal from said second solution to be deposited on said second band in said second cell, released from said second band into said third solution, and redeposited on said cathode in said third solution.

3. Method as in claim 2 wherein said second electrically conductive endless band is a metal band.

4. Method as in claim 1 wherein said metal deposited on said cathode in said second cell is mechanically removed outside of said second solution.

5. Method as in claim 1 wherein said current density is maintained at 150 $A/m^2$ at 60° C.

6. Method as in claim 5 wherein said band is circulated at a speed of 0.2 m/min.

7. Apparatus for the electrolytic recovery of a metal from a first solution containing ions of said metal, comprising a first cell adapted to contain a first solution containing electrolyte and ions of a metal to be recovered, an anode in said first cell, a second cell adapted to contain a second solution containing electrolyte, a cathode in said second cell, a first electrically conductive endless band extending from said first cell to said second cell, and roll means over which said endless band passes outside of said first and second cells so that said band serves as a cathode in said first solution and as an anode in said second solution.

8. Apparatus as in claim 7 further comprising a third cell for containing a third solution containing electrolyte, a cathode in said third cell, a second electrically conductive endless band extending from said second cell to said third cell, and roll means over which said second endless band passes outside of said second and third cells so that said second endless band serves as said cathode in said second solution and as an anode in said third solution.

9. Apparatus as in claim 8 wherein said cathode in said third cell comprises a third electrically conductive endless band which passes over roll means outside of said third cell.

10. Apparatus as in claim 7 wherein said first endless band comprises a first length in said first cell and a second length in said second cell, said first and second lengths being unequal.

11. Apparatus for electrolytic recovery and refining of metal from a solution, comprising a first cell adapted to contain a first solution containing electrolyte and ions of a metal to be recovered, an anode in said first cell, a second cell adapted to contain a second solution containing electrolyte, a third cell adapted to contain a third solution containing electrolyte, a cathode in said third cell, a first electrically conductive endless band on a route extending from said first cell to said second cell, roll means over which said endless band passes outside of said first and second cells so that said band serves as a cathode in said first solution and as an anode in said second solution, a second electrically conductive endless band on a route extended from said second cell to said third cell, and roll means over which said second endless band passes outside of said second and third cells so that said second endless band serves as said cathode in said second solution and as an anode in said third solution.

* * * * *